US010800562B2

(12) United States Patent
Baraccani et al.

(10) Patent No.: US 10,800,562 B2
(45) Date of Patent: Oct. 13, 2020

(54) UNIT AND METHOD FOR FILLING CONTAINING ELEMENTS OF SINGLE-USE CAPSULES

(71) Applicant: GIMA S.p.A., Zola Predosa, Bologna (IT)

(72) Inventors: Davide Baraccani, Ravenna (IT); Pierluigi Castellari, Bologna (IT)

(73) Assignee: I.M.A. INDUSTRIA MACCHINE AUTOMATICHE S.P.A., Bologna (IT)

( * ) Notice: Subject to any disclaimer, the term of this patent is extended or adjusted under 35 U.S.C. 154(b) by 390 days.

(21) Appl. No.: 15/324,499

(22) PCT Filed: Jul. 1, 2015

(86) PCT No.: PCT/IB2015/054957
§ 371 (c)(1),
(2) Date: Jan. 6, 2017

(87) PCT Pub. No.: WO2016/005857
PCT Pub. Date: Jan. 14, 2016

(65) Prior Publication Data

US 2018/0178935 A1 Jun. 28, 2018

(30) Foreign Application Priority Data

Jul. 8, 2014 (IT) ..... BO2014A000383

(51) Int. Cl.
*B65B 29/02* (2006.01)
*B65B 1/30* (2006.01)
(Continued)

(52) U.S. Cl.
CPC ..... *B65B 29/022* (2017.08); *B65B 1/14* (2013.01); *B65B 1/24* (2013.01); *B65B 1/30* (2013.01);
(Continued)

(58) Field of Classification Search
CPC ..... B65B 29/02; B65B 29/022; B65B 29/025; B65D 85/8046
(Continued)

(56) References Cited

U.S. PATENT DOCUMENTS 2,630,997 A 3/1953 Curtis
3,550,650 A 12/1970 Yamashita
(Continued)

FOREIGN PATENT DOCUMENTS

CN 2142437 Y 9/1993
CN 1483646 A 3/2004
(Continued)

OTHER PUBLICATIONS

Chinese Office Action in corresponding Patent Application No. 201580037151.7 dated Jul. 3, 2018.
(Continued)

*Primary Examiner* — Andrew M Tecco
*Assistant Examiner* — Eyamindae C Jallow
(74) *Attorney, Agent, or Firm* — Renner, Otto, Boisselle & Sklar, LLP

(57) ABSTRACT

A filling unit for filling containing elements (2) of single-use capsules (3) with a dose (33) of product for extraction or infusion beverages, comprising:—a line (4) for transporting the containing elements (2);—a station (SR) for filling the containing elements (2) with a dose (33) of product comprising at least a first containing seat (S1) designed to receive a dose (33) of product; a substation (ST1) for forming the dose (33) inside the first containing seat (S1) equipped with a device (6) for releasing a predetermined quantity of product defining the dose (33) inside the first containing seat (S1), the release device (6) comprising: a hopper (38) for feeding product; at least one rotary element (40*a*; 40*b*) having a plurality of blades (60A, 60B, 60C, 60D,
(Continued)

60E, 60F); and a filling chamber (61) positioned below the rotary element (40*a*; 40*b*), the rotary element (40*a*; 40*b*) being configured to create a feeding flow of product from the feed hopper (38) towards the filling chamber (61).

11 Claims, 10 Drawing Sheets

(51) Int. Cl.

| | |
|---|---|
| ***B65B 1/38*** | (2006.01) |
| ***B65B 1/14*** | (2006.01) |
| ***B65B 1/36*** | (2006.01) |
| ***B65B 63/02*** | (2006.01) |
| ***B65B 1/24*** | (2006.01) |

(52) U.S. Cl.
CPC ..... *B65B 1/363* (2013.01); *B65B 1/385* (2013.01); *B65B 63/022* (2013.01)

(58) Field of Classification Search
USPC ..... 426/77
See application file for complete search history.

(56) References Cited

U.S. PATENT DOCUMENTS

| | | | | | |
|---|---|---|---|---|---|
| 4,629,093 | A * | 12/1986 | Le Molaire | F42B 33/0292 | 141/129 |
| 5,287,993 | A * | 2/1994 | Ford | A47J 31/404 | 222/135 |
| 5,409,137 | A * | 4/1995 | Bonomelli | B65B 1/36 | 222/217 |
| 5,649,412 | A * | 7/1997 | Binacchi | B65B 9/023 | 426/77 |
| 5,791,127 | A * | 8/1998 | Rossi | B65B 1/363 | 53/202 |
| 10,144,541 | B2 * | 12/2018 | Rea | B65B 29/02 | |
| 2011/0146840 | A1 | 6/2011 | Ansaloni et al. | | |
| 2012/0067223 | A1 | 3/2012 | Vuagniaux et al. | | |
| 2012/0190521 | A1 * | 7/2012 | Rivera | B31D 5/0082 | 493/58 |
| 2015/0027085 | A1 * | 1/2015 | Rea | B65B 29/02 | 53/282 |
| 2016/0176555 | A1 * | 6/2016 | Castellari | B65B 29/02 | 53/167 |
| 2017/0121044 | A1 * | 5/2017 | Castellari | B65B 29/02 | |

FOREIGN PATENT DOCUMENTS

| | | | | |
|---|---|---|---|---|
| CN | 103118650 | A | 5/2013 | |
| WO | 92/20579 | A1 | 11/1992 | |
| WO | 01/34475 | A1 | 5/2001 | |
| WO | WO-0134475 | A1 * | 5/2001 | B65B 1/36 |
| WO | WO 0134475 | A1 | 5/2001 | |
| WO | 2013/144837 | A1 | 10/2013 | |

OTHER PUBLICATIONS

International Search Report and Written Opinion for corresponding Patent Application No. PCT/IB2015/054957 dated Sep. 2, 2015.
Search Report for corresponding Italian Patent Application No. BO20140383 dated Mar. 25, 2015.

* cited by examiner

UNIT AND METHOD FOR FILLING CONTAINING ELEMENTS OF SINGLE-USE CAPSULES

This application is a national phase of International Application No. PCT/IB2015/054957 filed Jul. 1, 2015 and published in the English language, which claims priority to Italian Patent Application No. BO2014A000383 filed Jul. 8, 2014, which are hereby incorporated herein by reference in their entirety.

TECHNICAL FIELD

This invention relates to a unit and a method for filling containing elements of single-use capsules for extraction or infusion beverages with a dose of product.

BACKGROUND ART

The prior art capsules, used in machines for making extraction or infusion beverages, comprise in their simplest form, the following:

- a rigid, cup-shaped outer container comprising a perforatable or perforated bottom and an upper aperture provided with a rim (and usually, but not necessarily, having the shape of a truncated cone);
- a dose of product for extract or infusion beverages contained in the outer container;
- and a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, the capsules may comprise one or more rigid or flexible filtering elements.

For example, a first filter (if present) may be located on the bottom of the rigid container. A second filter (if present) may be interposed between the piece of sealing sheet and the product dose.

The dose of product may be in direct contact with the rigid, cup-shaped outer container, or with a filtering element.

The capsule made up in this way is received and used in specific slots in machines for making beverages.

In the technical sector in question, the need is particularly felt for filling in a simple and effective way the rigid, cup-shaped containers or the filtering elements whilst at the same time maintaining a high productivity.

A technical problem particularly felt in the sector in question is also that of filling the rigid, cup-shaped containers with the same predetermined quantity of product, that is to say, that of reducing the variability of the weight of product introduced in the rigid, cup-shaped containers (relative to each other).

This problem is particularly felt by the final users of these machines (capsule manufacturers), who need to produce capsules all filled with the same predetermined quantity of product; that is, they have the absolute need to reduce the variability of the weight of product between the capsules (statistically reducing the variability of the weight between the various capsules).

It should be noted that, in this regard, there are prior art packaging machines having a filling unit which allows the simultaneous filling of several parallel rows of rigid, cup-shaped containers, which are advancing. In this case, each row of rigid, cup-shaped containers is associated with a dedicated filling device, generally equipped with a screw feeder to allow the descent of the product inside the container.

This type of unit is therefore obviously quite expensive and complex, since it comprises a plurality of devices and drives (one for each screw device) which are independent from each other and which must necessarily be coordinated.

Moreover, the overall reliability of the machine resulting from this configuration/arrangement of elements is necessarily limited because the rate of faults is inevitably linked with the number of devices and drives present.

Moreover, the screw feeder devices may have drawbacks due to clogging, soiling and poor dosing accuracy. More in detail, the end part of the screw feeder is not normally able to retain the product, which therefore falls and soils the machine.

A strongly felt need by operators in this sector is that of having a unit and a method for filling containing elements (rigid, cup-shaped containers) of single-use capsules for extraction or infusion beverages which are particularly simple, reliable and inexpensive and at the same time maintain a high overall productivity.

DISCLOSURE OF THE INVENTION

The aim of this invention is therefore to satisfy the above-mentioned need by providing a unit and a method for filling containing elements (rigid, cup-shaped containers) of single-use capsules for extraction or infusion beverages which can be made relatively simply and inexpensively and which is particularly reliable.

A further aim is to provide a method and a machine for packaging single-use capsules for extraction or infusion beverages which allow the cup-shaped containers to be filled with the same predetermined quantity of product, reducing the variability of the weight of product introduced between one cup-shaped container and another.

Yet another aim of the invention is to provide a machine for packaging single-use capsules for extraction or infusion beverages which can guarantee a high productivity.

BRIEF DESCRIPTION OF DRAWINGS

The technical features of the invention, with reference to the above aims, are clearly described in the claims below and its advantages are apparent from the detailed description which follows, with reference to the accompanying drawings which illustrate a non-limiting example embodiment of the invention and in which:

DETAILED DESCRIPTION OF PREFERRED EMBODIMENTS OF THE INVENTION

With reference to the accompanying drawings, the numeral 1 denotes a unit for filling containing elements of single-use capsules 3 for extraction or infusion beverages, with a dose 33 of solid product in powder, granules or leaves, such as coffee, tea, milk, chocolate, or combinations of these.

The filling unit 1 is particularly suitable for filling containing elements of single-use capsules 3 with products in powder, preferably coffee.

Figure 2:
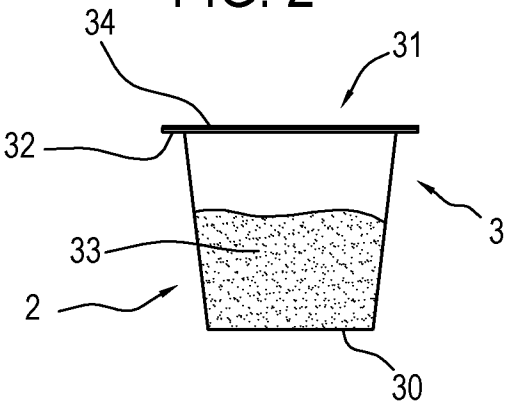
FIG. 2 is a schematic view of a single-use capsule for beverages which can be made by the machine of FIG. 1.

More specifically, as illustrated in FIG. 2, the single-use capsules 3 for extraction or infusion beverages comprise, in a minimum, but non-limiting, embodiment: a rigid, cup-shaped container 2 (usually to define a frustoconical shape) comprising a base 30 and an upper opening 31 equipped with a collar 32; a dose 33 of extraction or infusion product contained in the rigid container 2 and a lid 34 for closing the upper opening 31 of the rigid container 2.

It should also be noted that this type of capsule 3 may also comprise one or more filtering or product retaining elements (not illustrated here for simplicity reasons).

In the capsule 3 illustrated in FIG. 2, the rigid, cup-shaped container 2 defines the containing element to be filled with a dose 33 of product.

Other types of capsules may be filled with the filling unit according to the invention, for example capsules wherein the dose 33 of product is contained in, and retained by, a filtering element connected to the rigid container, wherein the rigid container can be closed at the bottom, or open.

In other words, in capsules not illustrated, a filtering element may contain and retain the dose 33 of product, forming the containing element in combination with the rigid container with which it is coupled.

In the following description, reference will be made to the rigid, cup-shaped container 2, but it is understood that the invention can be made with reference to capsules wherein the containing element is formed by a filtering element (or other components of the capsule designed to contain a dose 33 of product) and by the respective rigid container to which it is connected.

It should be noted that the filling unit 1 comprises a line 4 for transport (that is to say, movement) of rigid, cup-shaped containers 2 designed to contain a predetermined quantity of extraction or infusion product (dose 33) and a filling station SR.

The transport line 4 extends along a first movement path P and is provided with a plurality of seats 5 for supporting the rigid containers 2, arranged in succession along the first path P.

Preferably, the first movement path P is a closed path lying on a horizontal plane.

The supporting seats 5 are arranged one after another, not necessarily continuously.

In addition, the supporting seats 5 each have a corresponding vertical axis of extension.

It should be noted that the transport line 4 comprises a transport element 39 to which the supporting seats 5 are connected to be moved along the first path P.

It should be noted that the transport element 39 is closed in a loop around movement means 17 which rotate about vertical axes for moving the transport element 39.

Preferably, the transport element 39 is a chain 40 comprising a plurality of links, hinged to one another in succession about corresponding vertical axes, to form an endless loop.

It should be noted that at least one of the links comprises at least one supporting seat 5 with a vertical axis for corresponding rigid container 2 which can be positioned with the opening 31 facing upwards.

It should be noted that the chain 40 may comprise both links having a corresponding supporting seat 5 and connecting links which are not provided with supporting seats 5 and which are interposed between links provided with supporting seats 5. Therefore, preferably, a certain number of links comprises each supporting seat 5.

Preferably, but not necessarily, the movement means 17 rotate continuously about vertical axes to allow the transport element 39 to move continuously.

Described below is the station SR for filling the rigid, cup-shaped containers 2.

The station SR for filling the rigid, cup-shaped containers 2 comprises:

- at least a first containing seat S1 designed to receive a dose 33 of product;
- a substation ST1 for forming the dose 33 inside the first containing seat S1, provided with a device 6 for releasing a predetermined quantity of product forming the dose 33 inside the first containing seat S1;
- at least a second containing seat S2 designed to receive the dose 33 of product from the first containing seat S1;
- a substation ST2 for transferring the dose 33 of product from the first containing seat S1 to the second containing seat S2;
- devices 7 for moving the first containing seat S1 between the forming substation ST1 and the transfer substation ST2 and vice versa;
- a substation ST3 for releasing the dose 33 of product from the second containing seat S2 to a rigid, cup-shaped container 2 transported by the transport line 4;
- further devices 8 for moving the second containing seat S2 between the transfer substation ST2 and the release substation ST3 and vice versa.

More specifically, in one aspect, the release device comprises at least one rotary element 40*a*, designed to rotate about a respective axis of rotation to release the product inside the at least one first containing seat.

All the above-mentioned components forming part of the filling station SR of the rigid, cup-shaped containers 2 are described below in more detail, with particular reference to the accompanying drawings.

It should be noted that the devices 7 for moving the first containing seat S1 comprise a first element 9 rotating about a first axis X1 of rotation which is substantially vertical, on which is connected the first containing seat S1 to be rotated about the first vertical axis X1 of rotation.

Preferably, the first rotary element 9 comprises a wheel 9*a*, connected to respective means for driving the rotation.

More specifically, preferably, the filling station SR comprises a plurality of first seats S1.

The first seats S1 are connected radially to the first rotary element 9 (more precisely to the wheel 9*a*) to be rotated with it.

Preferably, the first seats S1 are made directly in the first rotary element 9, in particular they are made directly in the wheel 9*a*.

It should be noted that the first seats S1 are positioned along an arc of a circle, preferably along a circumference having as the centre a point of the first axis X1.

Still more preferably, the first seats S1 are angularly equispaced from each other along a circumference having as the centre a point of the first axis X1.

It should be noted that each first seat S1 follows a second path P1, preferably circular having as the axis of rotation the first axis X1 in such a way as to engage cyclically—during rotation—the substations for forming (ST1) and transferring (ST2) the dose.

Alternatively, the first seats S1 are connected to the first rotary element 9 by means of a rod (not illustrated), which is movable radially relative to the first rotary element 9.

Each first seat S1 is defined, preferably, by lateral walls of a cavity 18 and by a bottom wall F. Preferably, the cavity 18 is a cylindrical cavity.

Furthermore, still more preferably, the cavity 18 has a vertical axis of extension (parallel to the first axis X1 of rotation).

Again, preferably, the filling station SR comprises, for each first seat S1:

- a piston 13, which is movable between a lower position where it defines the bottom wall F of the first seat S1 and an upper position in which fully occupies the space of the first seat S1, or in other words, closes the top of the cavity 18;
- means 14 for moving the piston 13, configured for moving the piston 13 between the above-mentioned lower and upper positions.

Examples of movement means 14 are electric motors, pneumatic devices, cam devices, and other prior art devices.

It should be noted that the expression "the piston 13 fully occupies the space" means that the piston 13 is positioned in the seat so as not to allow the presence of the dose 33 inside the first seat S1.

Preferably, the filling station SR comprises movement means 14 which are independent for each piston 13, so that each piston can be moved independently of the others.

Preferably, the cavities 18 are through cavities and the pistons 13 are movable in a linear fashion inside the cavities 18, for varying the space of the first seats S1 (lower position) and for expelling the doses 33 from the first seats S1 (upper position).

The forming ST1 and transfer ST2 substations are positioned along the periphery of the first rotary element 9 in such a way as to be engaged cyclically by the first seats S1 during rotation around the first axis X1.

More specifically, the forming ST1 and transfer ST2 substations are arranged in a predetermined position relative to a frame 29 of the filling station SR, along the second movement path P1 of the first seat S1.

In this regard, it should be noted that in a complete rotation of the first rotary element 9 each of the first seats S1 is positioned in the forming substation ST1 and in the transfer substation ST2.

Preferably, the second movement path P1 is closed. Preferably, the second movement path P1 is a circular path around the first axis X1.

Still more preferably, the second path P1 lies on a horizontal plane.

Described below is the substation ST1 for forming the dose 33.

The substation ST1 for forming the dose 33 is positioned in a region R1 for forming the dose 33.

With reference to the substation ST1 for forming the dose 33, it should be noted that at that substation there is the release device 6, designed for releasing a predetermined quantity of product (defining the dose 33) inside the containing seat S1 positioned in the region R1 for forming the dose 33. The release device 6 comprises preferably a feed tank (or hopper) 38 filled, in use, with product.

Moreover, the release device 6 comprises at least one element (40*a*; 40*b*) rotating about a respective axis of rotation (X4; X5) and having a plurality of blades (60A, 60B, 60C, 60D, 60E, 60F) extending away from the axis of rotation (X4; X5).

In the embodiments illustrated, the blades (60A, 60B, 60C, 60D, 60E, 60F) are positioned tangential to a circle centred on the axis of rotation.

In an embodiment not illustrated, the blades (60A, 60B, 60C, 60D, 60E, 60F) are radial blades. It should be noted that the term radial blades (60A, 60B, 60C, 60D, 60E, 60F) means elements protruding in the direction perpendicular to the axis of rotation, configured for moving the product. Preferably, the feed tank 38 is positioned above the rotary element (40*a*; 40*b*), so as to feed by dropping the product to the rotary element (40*a*; 40*b*). Moreover, it should be noted that the release device 6 comprises a filling chamber 61 positioned below the rotary element (40*a*; 40*b*) and defining a (predetermined) volume for receiving the product.

The above-mentioned rotary element (40*a*; 40*b*) is positioned inside a shell 64, the shell 64 being in communication (at the top) with the feed tank 38 (for receiving the product) and (at the bottom) with the filling chamber 61 (for releasing the product).

Preferably, the shell 64 has a cylindrical internal shape if the release device 6 comprises a single rotary element (40*a*; 40*b*), whilst it has a shape defined by two cylinders if the device 6 comprises a first and a second rotary element (40*a*; 40*b*).

Figure 3:
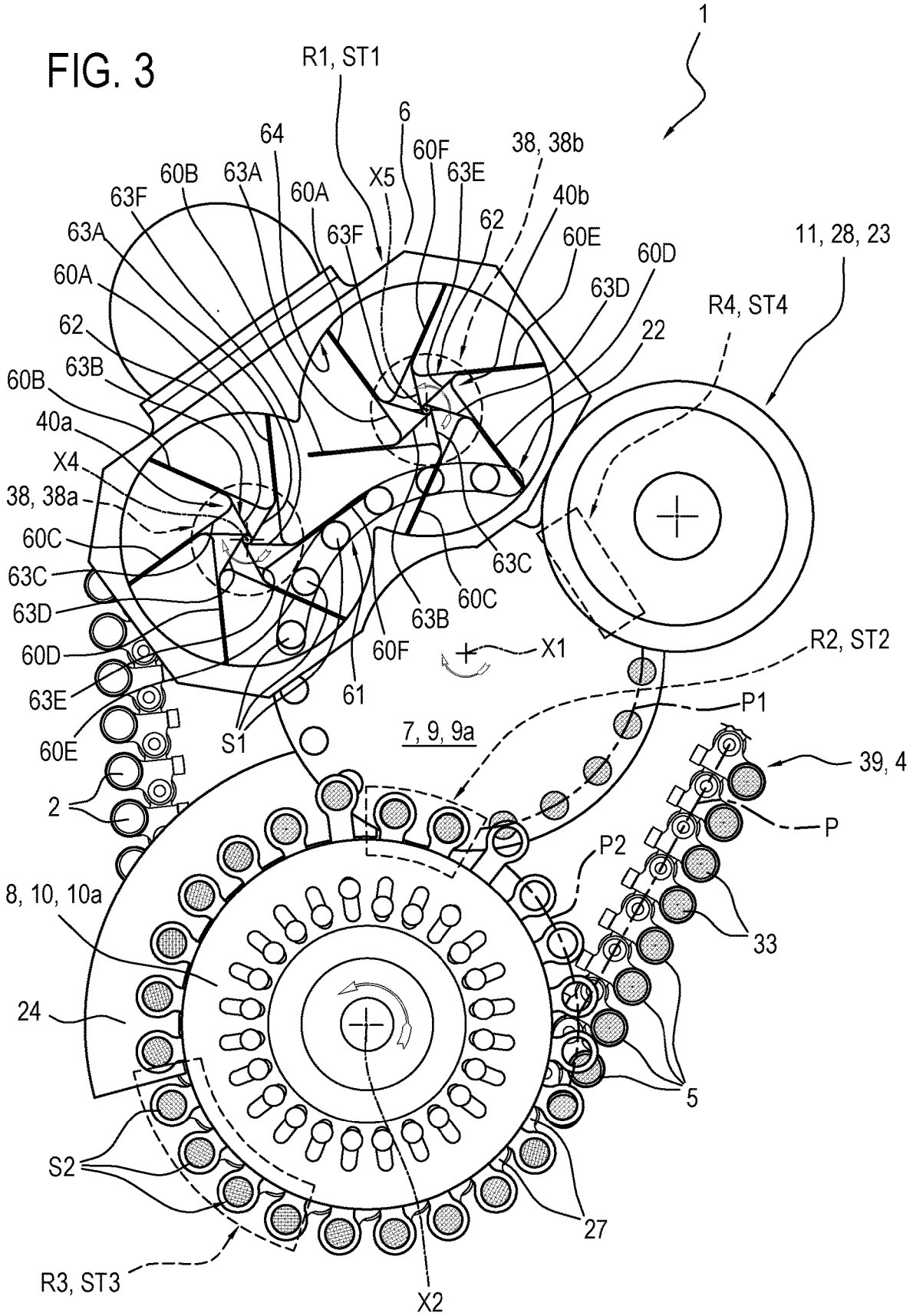
FIG. 3 is a corresponding top plan view of the filling unit of FIG. 1 according to a first embodiment of the invention.
Figure 4:
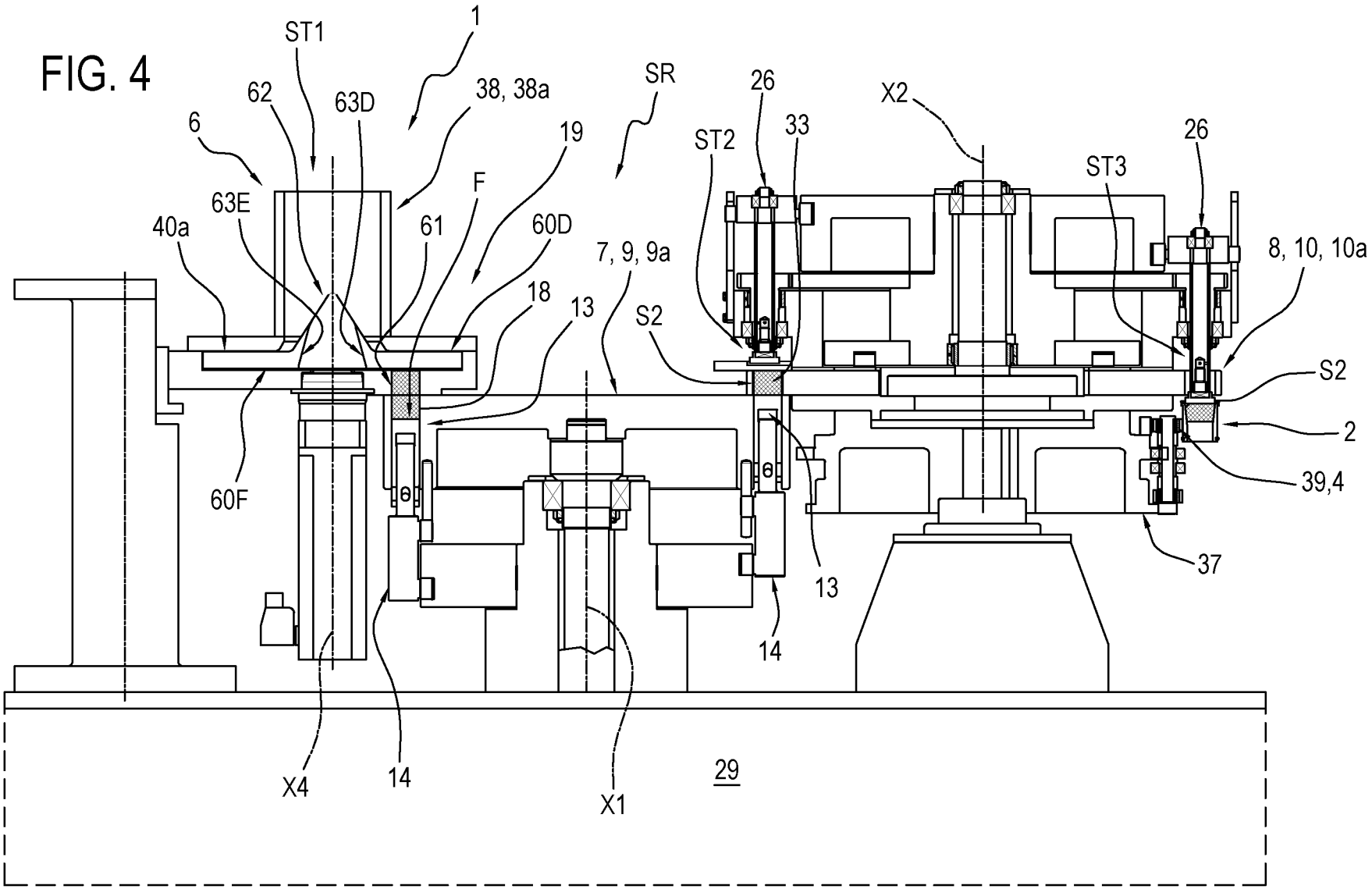
FIG. 4 is a schematic cross section view of a filling station of the filling unit of FIG. 3, with some parts cut away to better illustrate others.
Figure 5:
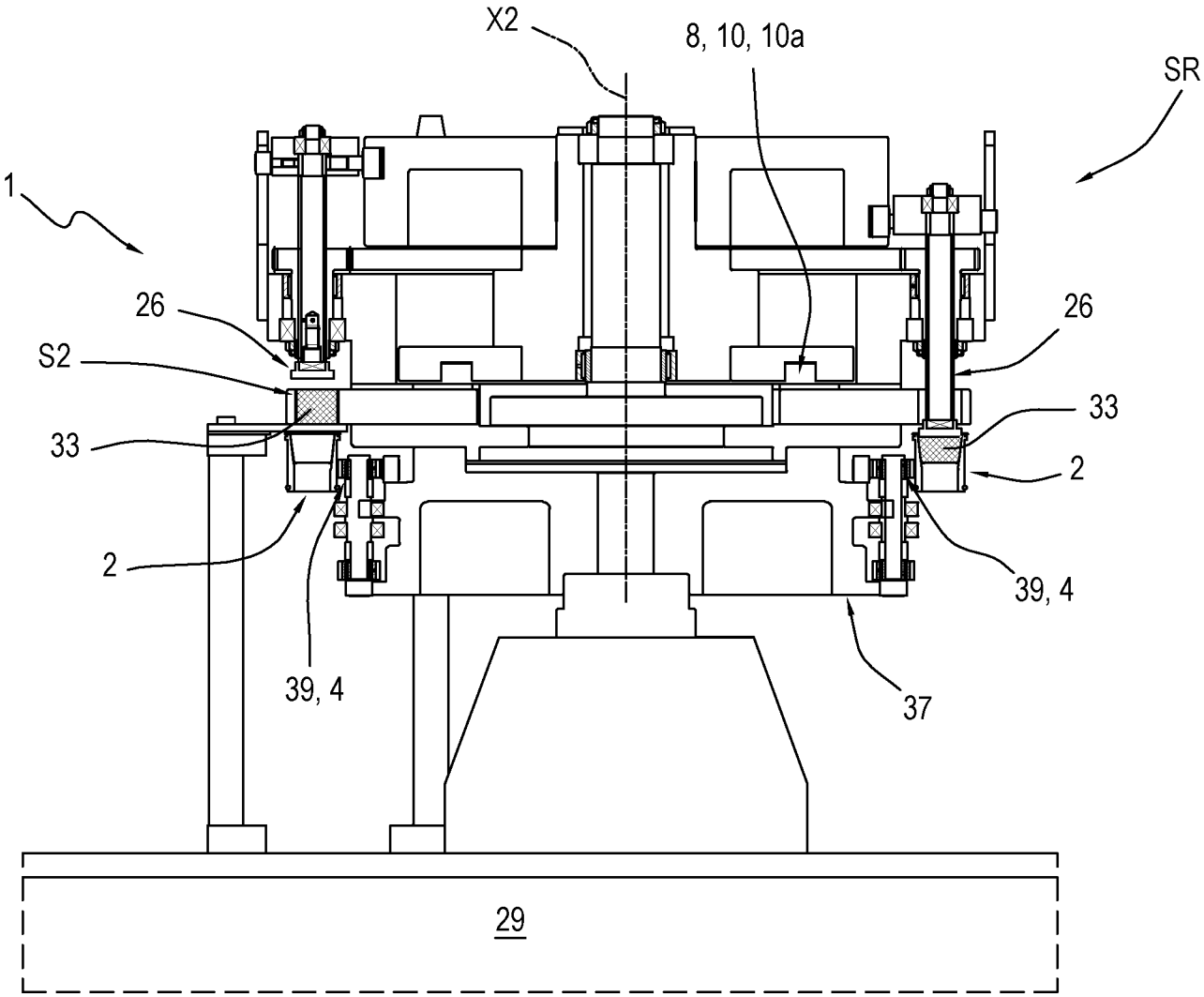
FIGS. 5 and 6 are respective schematic cross sections of components of the filling station of FIG. 4, with some parts cut away to better illustrate others.
Figure 11:
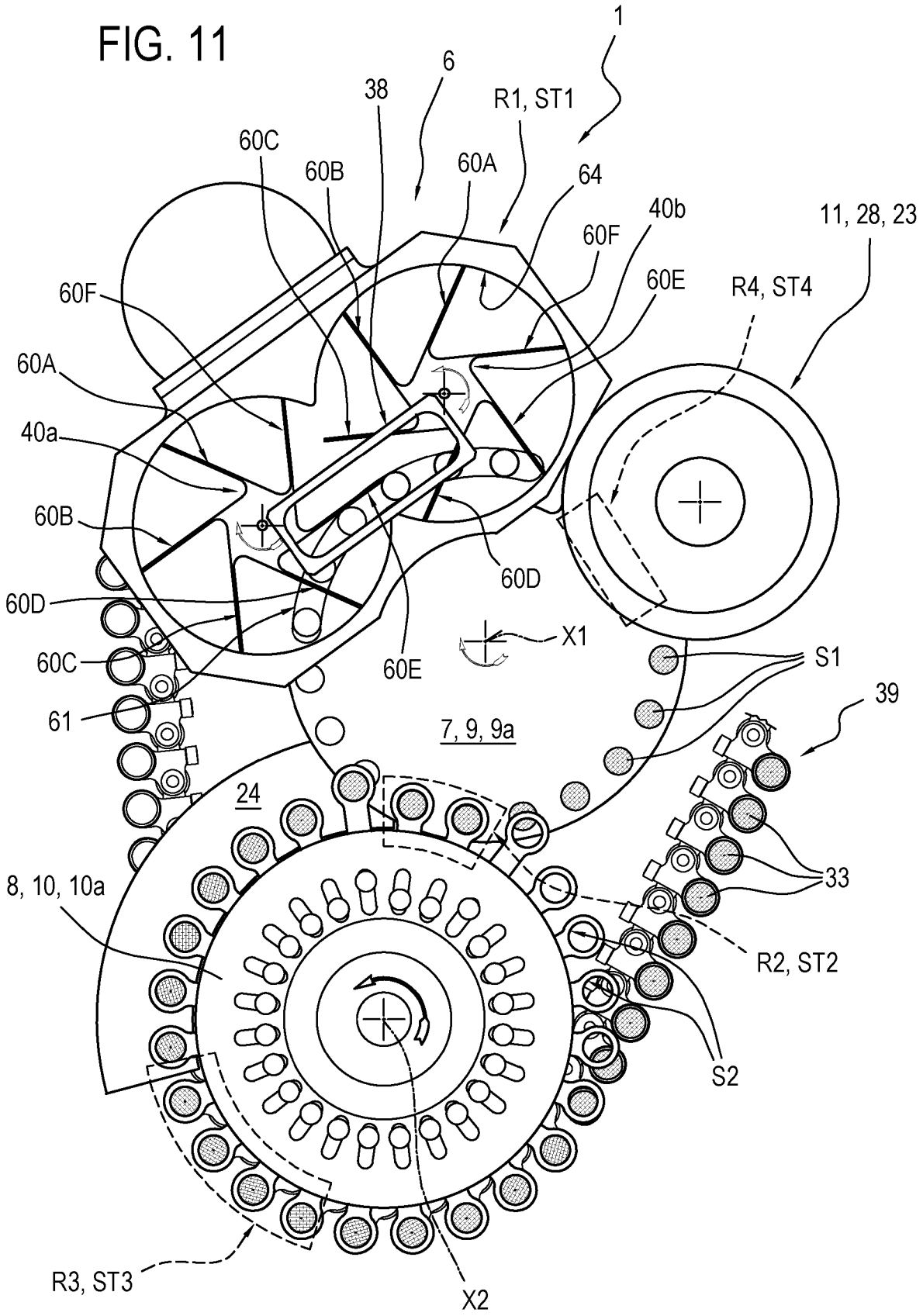
FIG. 11 is a corresponding top plan view of the filling unit of FIG. 1 according to a second embodiment of the invention.
Figure 13:
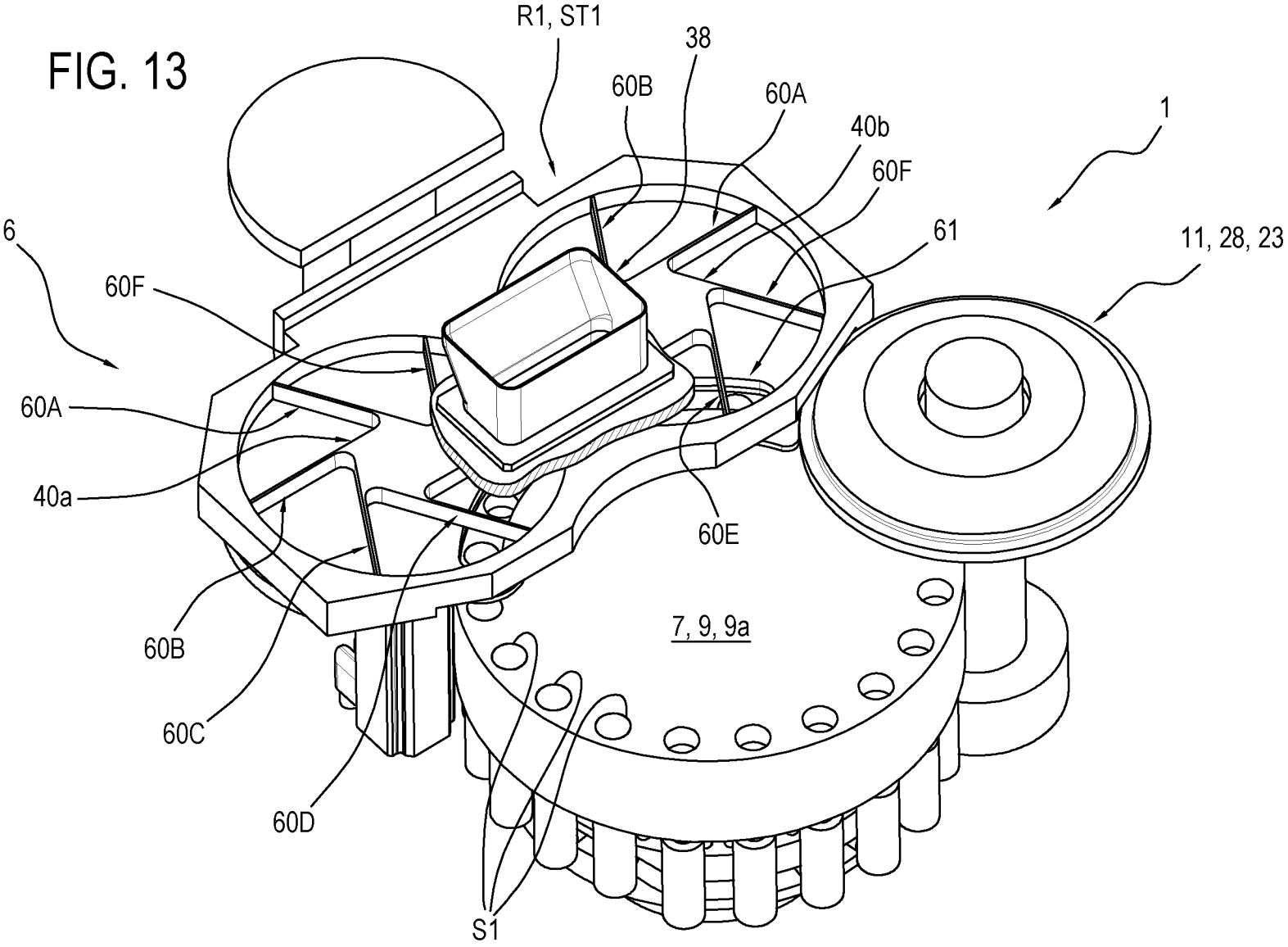
FIG. 13 is a schematic perspective view of the filling unit of FIG. 1 according to a third embodiment of the invention, with some parts cut away to better illustrate others.
Figure 14:
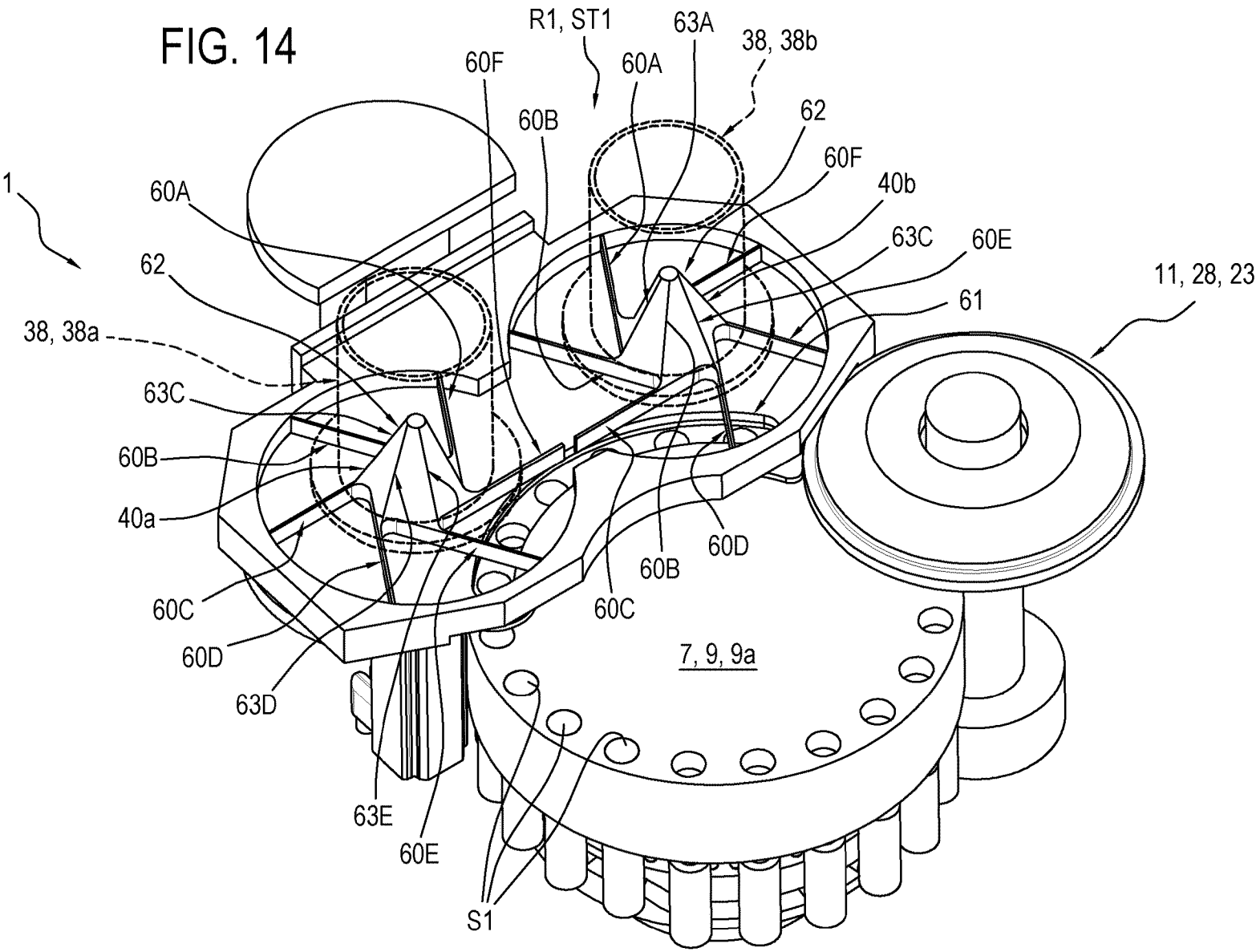
FIG. 14 is a schematic perspective view of the filling unit of FIG. 1 according to a fourth embodiment of the invention, with some parts cut away to better illustrate others.

If the device 6 comprises a first and a second rotary element (40*a*; 40*b*), the shell 64 has a shape defined by two cylinders, intersecting as in the embodiments of FIGS. 3 and 11, tangential as in the embodiments of FIGS. 13 and 14, or separated (not illustrated).

In other embodiments not illustrated, the release device 6 may comprise several rotary elements, in particular more than two rotary elements, each positioned inside a respective shell separated from the others, or inside a shell single, where adjacent rotary elements may be intersecting, or tangential, or spaced apart.

As will be described in more detail below, the filling chamber 61 releases the product inside the at least one first seat S1 at the dose forming region R1.

It should be noted that, according to the invention, the rotary element (40*a*; 40*b*) is configured for creating a feed flow of product from the feed tank 38 towards the filling chamber 61.

In other words, the rotary element (40*a*; 40*b*) allows the filling chamber 61 to be kept filled with a constant volume of product (equal to the volume defined by the chamber itself), moving (inside the respective shell 64) a flow of product made available (by dropping) from the feed tank 38.

It should be noted that, preferably, the filling chamber 61 is arc shaped (preferably circular).

Preferably, the filling chamber 61 occupies a portion (arched) of the movement path P1 of the first seats S1.

With reference to the geometry of the filling chamber 61, preferably the first seat S1 has a circular shape, in plan, having a predetermined diameter and the filling chamber 61 has, at least at a lower outlet portion, a width, in plan, substantially equal to the predetermined diameter of the first seat S1.

In this way it should be noted that, in plan, the outlet portion of the filling chamber 61 is superposed perfectly on the first seats S1.

It should be noted that the filling chamber 61, in the preferred embodiment, releases the product at a plurality of first seats S1 positioned temporarily in the region R1, that is to say, opposite below the filling chamber 61.

It should be noted that the release device 6 also comprises drive means (such as, for example, a drive unit), operatively coupled to the relative element, for rotating the rotary element (40*a*; 40*b*).

According to another aspect, as illustrated in FIGS. 3 and 14, the at least one rotary element (40*a*; 40*b*) comprises an upper portion 62, advantageously tapered for comprising a plurality of protrusions—preferably radial—(63*a*, 63*b*, 63*c*, 63D, 63E, 63F) for moving the product inside the feed tank 38.

It should be noted that this upper tapered portion 62 of the rotary element (40*a*; 40*b*) has the function of moving the product present in the tank 38 away from the axis of the rotary element (40*a*; 40*b*), so as to favour the descent and the distribution of product towards the blades (60A, 60B, 60C, 60D, 60E, 60F).

In an embodiment of the invention not illustrated, the portion 62 may have a smooth outside surface, not tapered and without protrusions, for example in the shape of a dome or cone.

Figure 6:
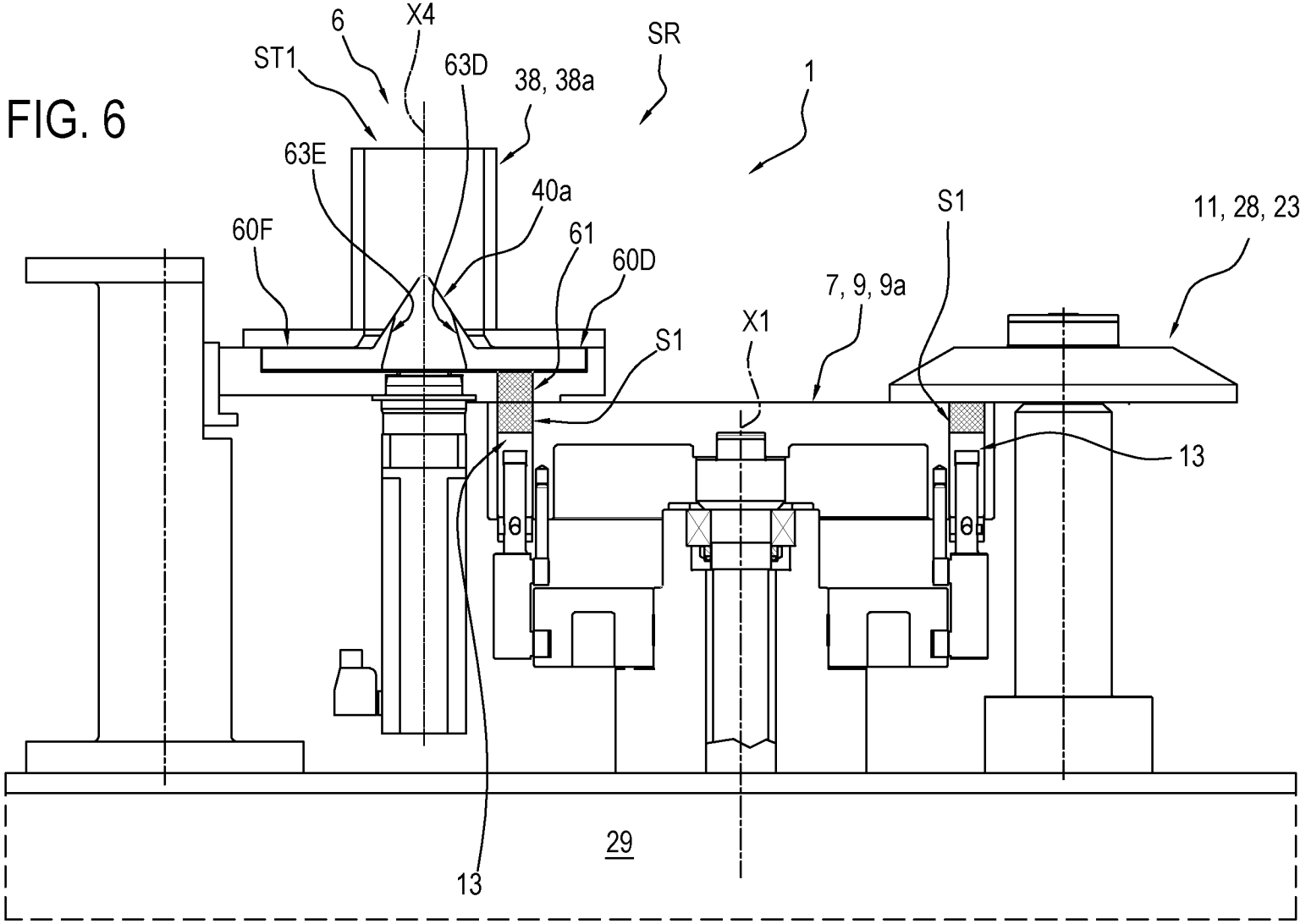
Figure 7:
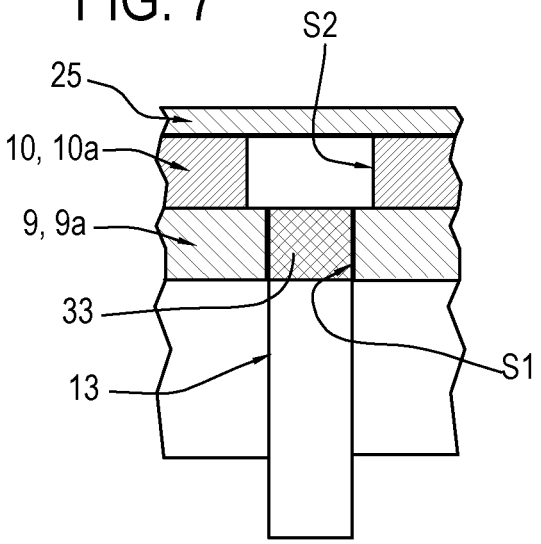
FIGS. 7 to 10 schematically illustrate some operating steps of a method according to the invention performed in the filling station of the filling unit according to the invention.

It should be noted that, according to this embodiment illustrated in FIGS. 3, 6 and 14, preferably the axis of rotation (X4; X5) of the rotary element (40*a*; 40*b*) intercepts the tank 38.

Preferably, the axis of rotation X4 is vertical.

The axis of rotation (X4; X5) of the first rotary element (40*a*; 40*b*) is stationary relative to the tank 38, or equally, to the frame 29.

Figure 12:
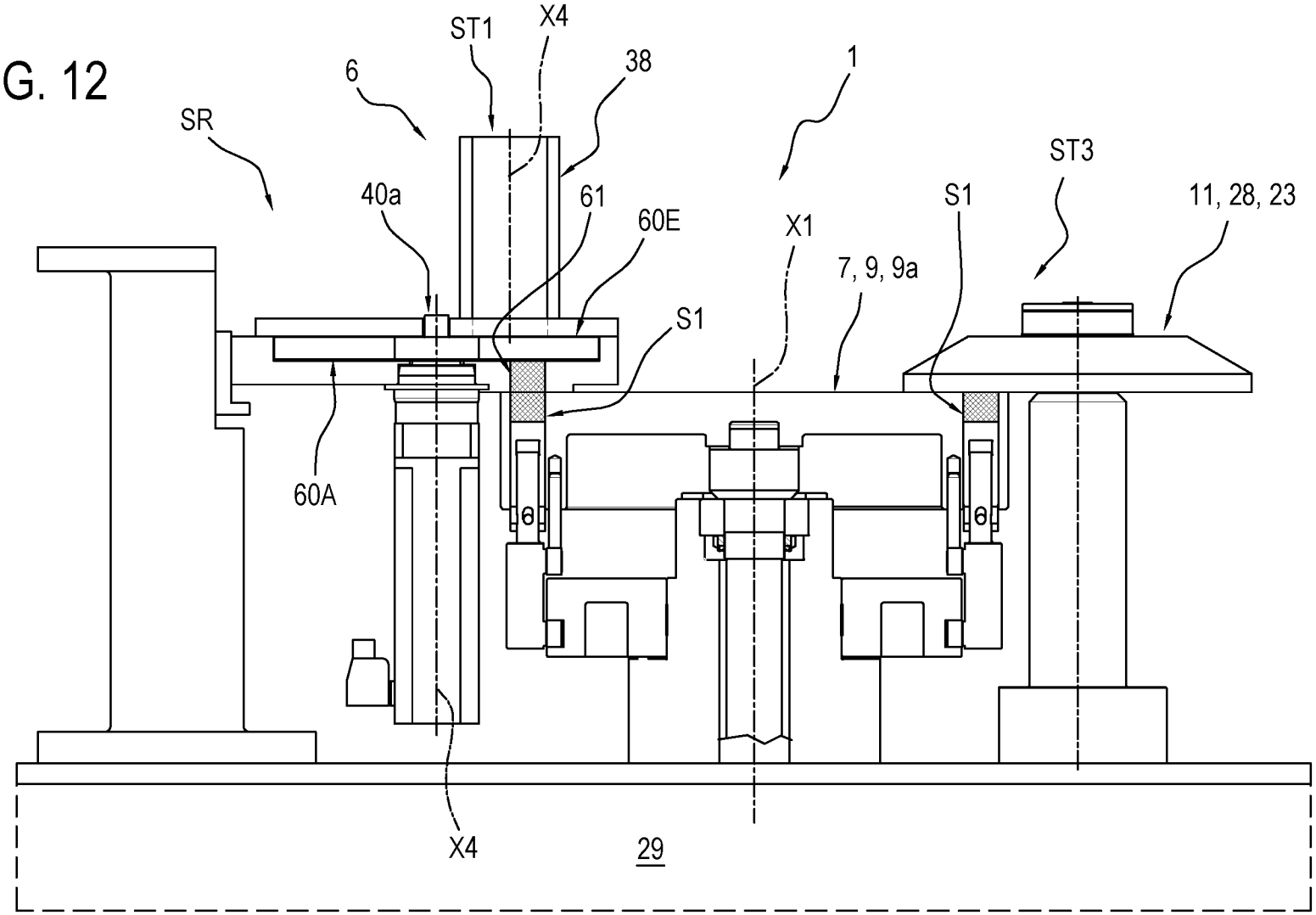
FIG. 12 is a schematic cross section view of a filling station of the filling unit of FIG. 11, with some parts cut away to better illustrate others.

It should be noted that the accompanying drawings illustrate two embodiments of the release device 6, a first embodiment according to FIGS. 3, 6 and 14 and a second embodiment according FIGS. 11, 12 and 13.

According to both the embodiments illustrated (FIGS. 3, 6 and 14; FIGS. 11, 12 and 13) the release device 6 comprises a first rotary element 40*a* and a second rotary element 40*b* both having a plurality of respective blades (60A, 60B, 60C, 60D, 60E, 60F) and acting in conjunction with each other so as to create a feed flow of product from the feed tank(s) 38 towards the filling chamber 61 (to keep the filling chamber filled 61).

According to these embodiments, the first rotary element 40*a* is configured to rotate about a respective first axis X4 of rotation, whilst the second rotary element 40*b* is configured to rotate about a respective second axis X5 of rotation.

Preferably, both the axes (X4, X5) of rotation are vertical.

Also, preferably, both the axes (X4, X5) of rotation are fixed relative to the frame 29 of the unit 1.

According to an aspect, as illustrated in FIGS. 11 and 12, the release device 6 comprises a single tank 38 for feeding the product, designed to releasing product (by gravity, from the top downwards) towards the first and the second rotary element (40*a*, 40*b*).

According to another aspect, as illustrated in FIGS. 3, 6 and 14, the release device 6 comprises a first tank 38*a* for feeding the product and a second tank 38*b* for feeding the product, designed to release product respectively towards the first rotary element 40*a* and the second rotary element 40*b*.

More specifically, the first tank 38*a* for feeding is positioned above the first rotary element 40*a* whilst the second tank 38*b* for feeding the product is positioned above the second rotary element 40*b*.

More specifically, the first feed tank 38*a* is positioned relative to the first rotary element 40*a* so that the axis X4 of rotation of the first rotary element 40*a* passes inside the first tank 38*a*.

Also, the second feed tank 38*b* is positioned relative to the second rotary element 40*b* so that the axis X5 of rotation of the second rotary element 40*b* passes inside the second tank 38*b*.

More specifically, as illustrated in FIGS. 3, 6 and 14, both the tanks (38*a*, 38*b*) are cylindrical and positioned coaxially to the axes of the respective rotary elements (40*a*, 40*b*): the first tank 38*a* is coaxial with the axis X4 of rotation of the first rotary element 40*a* and the second tank 38*b* is coaxial with the axis X5 of rotation of the second rotary element 40*b*.

It should be noted more in general that the feed tank 38 may have any geometry: it may have a cylindrical, frusto-conical, parallelepiped shape etc.

With reference to the blades (60A, 60B, 60C, 60D, 60E, 60F) of each rotary element (40*a*; 40*b*), the following should be noted.

Preferably, according to the embodiments illustrated, the blades (60A, 60B, 60C, 60D, 60E, 60F) are positioned so that a surface with larger planar extension of the blades is parallel relative to a vertical plane.

According to these embodiments, the blades (60A, 60B, 60C, 60D, 60E, 60F) move the product according to a substantially horizontal speed component, in particular they apply on the product—due to the effect of their rotation about an axis—a substantially rotary motion.

Preferably, these blades (60A, 60B, 60C, 60D, 60E, 60F) have a predetermined extension in height (vertical), so as to act on a predetermined volume of product (preferably cylindrical).

Preferably, these blades (60A, 60B, 60C, 60D, 60E, 60F) have surfaces with larger planar extension which are substantially flat.

Alternatively, the blades (60A, 60B, 60C, 60D, 60E, 60F) are positioned so that a surface with larger planar extension of the blades is angularly inclined relative to a vertical plane.

With reference to the arrangement of the first and of the second rotary element (40*a*, 40*b*), the following should be noted.

According to the first and the second embodiment illustrated in FIGS. 3 and 11, the first and second rotary elements (40*a*, 40*b*) are positioned relative to each other in such a way that the trajectory of the blades of one intercepts the trajectory of the blades of the other.

According to this aspect, the first and second rotary elements (40*a*, 40*b*) are driven angularly according to a predetermined phase relationship (angular), so as to prevent the blades of the one striking the blades of the other.

Alternatively, according to the third and the fourth embodiment illustrated in FIGS. 13 and 14, the first and second rotary elements (40*a*, 40*b*) are positioned relative to each other in such a way that the trajectory of the blades of the one is different from the trajectory of the blades of the other (that is, in such a way that the trajectory of the blades of the one does not overlap, that is, does not intercept, the trajectory of the blades of the other).

According to yet another aspect, it should be noted that the control unit 15 of the machine 100 is designed to rotate the at least one first rotary element 40*a* of the release device 6 with a speed depending on the speed of movement of the first seat S1 by the first rotary unit 9 about the first of rotation axis X1.

Further, according to another aspect of the invention, the control unit 15 of the machine 100 is designed to rotate the at least one first rotary element 40*a* of the release device 6 with variable speed as a function of the quantity of product to be inserted inside each first seat S1. More in detail, it is possible to increase the quantity of product inserted inside each seat by increasing the speed of rotation of the first rotary element 40*a*, in such a way as to increase the apparent density of the product, and vice versa. In other words, it is possible to vary the quantity of product contained in the first seat S1, and hence in the capsules 3, by adjusting the speed of rotation of the at least one first rotary element 40*a*.

It should be noted that, advantageously, the presence of one or more rotary elements 40*a*, 40*b* prevents the product, in particular with powder type products (such as, for example, coffee), from creating blockages, that is, build-ups, inside the hopper which render incomplete the filling of the first seats S1 in transit through the region R1 for forming the dose.

Indeed, it should be noted that the one or more rotary elements 40*a*, 40*b* are rotated so as to move the product and prevent the formation of any blockage inside the hopper 38 for feeding the product.

In this way, advantageously, the speed at which the unit 1 may be used is particularly high and, consequently, the unit 1 is particularly fast and reliable in its operation.

Advantageously, it has been found experimentally that the filling device 6—defined by a rotary element (40*a*, 40*b*) with blades—in association the filling chamber 61 allows the variability of the filling of the different first seats S1 to be reduced, evening out the filling of the cup-shaped containers 2 and, therefore, fully satisfying the specifications requested by the manufacturers of capsules.

In effect, the rotary element (40*a*; 40*b*) with blades allows the product to be moved by falling from the feed tank 38 and therefore ensures the filling of the filling chamber 61 under every operating condition.

The filling chamber 61 thus defines a substantially constant volume, which means that the filling pressure (determined by the volume of product inside the chamber) is constant at different points of the same filling region and over time.

It has been found experimentally that the combination of at least one rotary element (40*a*; 40*b*) with blades and the underlying filling chamber 61 allows the variability of the quantity of product inserted in seats S1 to be reduced, thereby increasing the repeatability of the filling between the various seats S1, which translates into a greater uniformity of filling the cup-shaped containers/capsules 2.

Some aspects relating to the feed unit 1, in particular to the first seat S1, are described below.

The piston 13 (which defines the bottom of the first seat S1) occupies the lower position in at least one stretch of the region R1 for forming the dose 33.

In other words, the first seats S1, passing below the hopper 38, are filled with product, in a filling time which depends on the speed of transit of the first seats S1 in the forming region R1 and on the amplitude of the portion of the second movement path P1 of the first seats S1 occupied by the outfeed 19 of the hopper 38.

With reference to the movement of the piston 13 in the region R1 for forming the dose, the following should be noted.

Preferably, the piston 13 associated with the first seat S1 is positioned in the upper position where it prevents the filling of the first seat S1 (in this upper position the piston 13 closes the top of the seat 18 which defines the first seat S1) until the first seat S1 has completely entered inside the region R1 for forming the dose, at an infeed zone of the region R1 for forming the dose.

Also, preferably, when the above-mentioned first seat S1 is inside the region R1 for forming the dose, in particular at the infeed zone, the piston 13 associated with the first seat S1 is moved from the upper position to a lower end position.

The first seat S1 is therefore filled not only by gravity acting on the product which causes the product to enter the seat S1 but also due to the suction effect on the product caused by the movement (displacement) of the piston 13 from the upper position to the lower end position.

In this way, advantageously, thanks to the additional suction effect, the resulting speed of the machine 100 at the filling station SC, in particular at the substation ST1 for forming the dose, is particularly high.

It should be noted that in this lower end position, the first seat S1 defines a first space.

According to another aspect, it should be noted that the release device 6 is also equipped with a levelling device 22, located in such a way as to prevent the product being dispersed out of the region R1 for forming the dose 33, except for the product contained in the first seats S1, that is, the individual doses 33.

Basically, the levelling element 22 and the piston 13 define the dose 33 contained in the first seats S1.

According to the invention, by varying the position of the piston 13 by means of the movement means 14 in the region R1 for forming the dose 33 it is possible to vary the quantity of product contained in the first seats S1, or in other words, it is possible to vary the dose 33. Basically, the movement means 14 are designed to position the piston 13 in a dosing position, located between the lower position and the upper position, at the outfeed zone of the region R1 for forming the dose 33, to define the dose 33 in conjunction with the levelling element 22

Preferably, the filling station SR comprises a substation ST4 for compacting the dose 33.

The substation ST4 for compacting the dose 33 is positioned in a compacting region R4, along the second movement path P1 of the first seat S1 between the forming substation ST1 and the transfer substation ST2. The substation ST4 is optional and can be omitted.

More specifically, the compacting substation ST4 is equipped with compacting means 11 designed to compress the product, in phase with the piston 13, inside the first seat S1.

The compacting means 11 are described below in more detail.

The compacting means 11 comprise a compacting element 28. Preferably, the compacting element 28 comprises a compacting disk 23, or a fixed levelling element.

It should be noted that the compacting element 28 is connected to the (carried by the) frame 29 of the filling station SR.

The compacting element 28 is positioned on top of the first seats S1 at the compacting region R4.

It should be noted that the compacting element 28 comprises an upper face and a lower face. Preferably, the lower face is a planar face.

It should be noted that the lower face of the compacting element 28 defines, at the compacting region R4, an upper contact element of the dose 33 positioned inside the first seat S1, so as to compact the product, when the piston 13 is lifted into a compacting position, which is intermediate between the lower position and the upper position.

In other words, the means 14 for moving the piston 13 are designed to move the piston 13 from the lower position to the compacting position, that is to say, to bring the piston 13 towards the compacting element 28, in the compacting region R4, in such a way as to compact the dose 33.

It should also be noted that, according to an embodiment, the compacting element 28 is stationary relative to the frame 29.

The filling station SR is described below with particular reference to the second seat S2, the transfer substation ST2 and the release substation ST3.

It should be noted that the filling station SR comprises, preferably, a second rotary element 10 to which the second seat S2 is associated (connected).

It should be noted that, more generally, the second rotary element 10 forms the above-mentioned further devices 8 for moving the second seat S2 between the transfer substation ST2 and the release substation ST3 and vice versa.

The second rotary element 10 is configured to rotate about a second axis X2. Preferably, the second axis is parallel to the first axis X1. More preferably, the second axis X2 is vertical.

Preferably, the filling station SR comprises a plurality of second seats S2.

It should be noted that the second seat(s) S2 are connected to the second rotary element 10 so as to be rotated by it.

It should be noted that the second rotary element 10 comprises, preferably, a second wheel 10*a*, configured to rotate about the second axis X2, to which the second seats S2 are connected.

It should be noted that, by way of a non-limiting example, the second seats S2 in the embodiments illustrated are moved along a third circular path P2. More generally, the third path P2 is closed. Preferably, the third path P2 lies on a plane (horizontal).

More specifically, it should be noted that each second seat S2 is moved in a complete a rotation about the second axis X2, or more generally, around the third path P2, to the transfer station ST2 (in a transfer region R2) and to the release station ST3 (in a release region R3).

At the transfer region R2 the second seat S2 is positioned above, advantageously immediately above, the first seat S1.

More in detail, when the second seat S2 is positioned above the first seat S1 at the transfer region R2, the piston 13 is driven upwards for pushing the dose 33 of product from the first seat S1 to the second seat S2.

With reference to the second seat S2, it should be noted that preferably this seat is a through seat.

More specifically, the second seat S2 is preferably defined by a through cavity (preferably in the form of a hole). Preferably, the cavity is cylindrical. It should be noted that side walls of the second seat S2 are defined by side walls of the through cavity.

Preferably, the second seat S2 is connected to the second rotary element 10 by means of a rod 27.

According to an embodiment not illustrated, the second seat S2 is fixed to the second rotary element 10, that is, to the second wheel 10*a*.

For this reason, according to this embodiment, the radial position of the second seat S2 is constant relative to the second axis X2.

Preferably, in accordance with this embodiment, the plan extension of the second seat S2 is greater than the plan extension of the first seat S1 (in such a way that whilst the dose 33 of product fully occupies the space of the first seat S1, the dose 33 of product after the transfer does not fully occupy the space of the second seat S2).

It should be noted that the fact that the plan extension of the second seat S2 is greater than plan extension of the first seat S1 allows, in use, the transfer of the dose 33 from the first seat S1 to the second seat S2 in a transfer region R2 which is sufficiently large. This is particularly important for speeds of rotation of the first rotary element 9 and of the second rotary element 10 which are particularly high: in effect, the above-mentioned aspect ensures that the superposing of the second seat S2 on the first seat S1 and, therefore, the transfer of the dose 33 the first seat S1 to the second seat S2 can occur in predetermined angles of rotation of the first and the second rotary elements.

According to the embodiment illustrated, each second seat S2 is movable relative to the second rotary element 10, that is, relative to the second wheel 10*a*.

More specifically, preferably each second seat S2 is movable on a plane at right angles to the second axis X2.

Still more preferably, each second seat S2 is movable at least radially relative to the second axis X2.

It should be noted that the fact that the second seat S2 is movable on a plane at right angles to the second axis X2 makes it possible to extend the extension of the transfer region R2: in other words, it is possible to extend the zone where the second seat S2 superposes the first seat S1.

It should be noted that the transfer of the dose 33 from the first seat S1 to the second seat S2 is not instantaneous but is performed within an angle of rotation of the first rotary element 9 and of the second rotary element 10.

In this regard, it should be noted that the fact that the second seat S2 is movable radially relative to the second rotary element 10 allows a tracking of the first seat S1 during rotation of one or both the rotary elements (9, 10), so that it is possible to keep the second seat S2 superposed on the first seat S1 through an angle of rotation of the first rotary element 9 and the second rotary element 10 which is sufficiently large to allow the dose 33 to be transferred from the first seat S1 to the second seat S2.

In the embodiment illustrated, the plan extension of the second seat S2 may be reduced with respect to the embodiment (not illustrated) wherein the second seat S2 is fixed to the second rotary element 10, that is, to the second wheel 10*a*.

During transfer of the dose 33 from the first seat S1 to the second seat S2 the piston 13 supports the dose 33.

In another alternative embodiment not illustrated, each second seat S2 is movable relative to the second rotary element 10 that is, relative to the second wheel 10*a* both radially and in rotation about axes which are parallel to the second axis X2, that is, about vertical axes. Advantageously, cam means may move the second seats S2 radially and in rotation relative to the second rotary element 10 that is, relative to the second wheel 10*a*.

In this further alternative embodiment not illustrated, each second seat S2 has two degrees of freedom on horizontal planes which allow the second seats S2 to perfectly follow the first seats S1 in the transfer region R2.

In other words, each second seat S2 is exactly superposed on a corresponding first seat S1 in the transfer region R2. In this further alternative embodiment not illustrated, the first seats S1 and the second seats S2 can have a plan extension which is equal.

With reference to the position of the second rotary element 10 and of the transport element 39, it should be noted that, according to the example illustrated, the second rotary element 10 and the transport element 39 are positioned in such a way that a portion of the first path P of the supporting seats 5 is—according to a plan view—superposed on a portion of the third path P2 of the second seats S2.

Preferably, the superposed portions of the path between supporting seats 5 and second seats S2 are curvilinear portions of the path (preferably arcs).

It should be noted that, according to this aspect, the release of the dose 33 from the second seat S2 to the rigid, cup-shaped container 2 occurs at the superposed portions of path.

For this reason, the release substation ST3 is positioned at the portions of the path superposed.

It should be noted that, according to an embodiment not illustrated, the transfer of the dose 33 from the second seat S2 to the rigid, cup-shaped container 2 can also occur at a rectilinear portion of the first movement path P of the supporting seats 5, that is to say, a rectilinear portion of the movement line 4 of the rigid, cup-shaped container 2.

Preferably, according to this embodiment, the second seats S2 are movable at least radially relative to the second wheel 10*a*, in such a way as to maintain the superposing of the second seat S2 with the rigid, cup-shaped container 2 at a rectilinear stretch of the line 4 which is sufficiently large.

In other words, according to this embodiment, the movement (at least radial) of the second seat S2 relative to the second wheel 10*a*/second rotary element 10 ensures that the second seat S2, during rotation of the second rotary element 10, remains superposed on the rigid, cup-shaped container 2 being fed in the transport line 4 for a rectilinear stretch sufficiently long to allow the dose 33 to be released from the second seat S2 to the underlying rigid, cup-shaped container 2.

It should be noted that the filling station SR also comprises an upper contact element 25, present in the transfer region R2, which defines an upper stop for the dose 33 (as described in more detail below).

Preferably, the upper contact element 25 is a substantially planar plate.

It should be noted that the upper contact element 25 is fixed to the frame 29 of the filling station SR, that is, it is not rotated as one with the second rotary element 10.

More specifically, the upper contact element 25 is positioned in the transfer region R2 above the second seat S2.

The functionality of the upper contact element 25 is described below.

The filling station SR also comprises a supporting element 24 positioned along the third path P2 between the transfer substation ST2 and the release substation ST3.

It should be noted that the supporting element 24 forms a base for each second seat S2, at the portion of the third path P2 where the supporting element 24 is positioned: this will become clearer below, where the operation of the filling unit according to this invention and the method according to this invention are described.

The filling station SR may comprise, advantageously, according to the embodiments illustrated, one or more pushing elements 26. The pushing elements 26 are optionals and can be omitted.

The pushing element(s) 26 is/are movable, the operate(s) on the second seat S2 at the release substation ST3.

In the embodiments illustrated, the filling station SR comprises a pushing element 26 associated with each second seat S2.

For this reason, according to the embodiments illustrated, the filling station SR comprises a plurality of pushing elements 26, one for each second seat S2.

It should be noted that the pushing elements 26 are integral with the second rotary element 10, in such a way as to be rotated with it.

In addition, the pushing element 26 is movable between a raised position, in which it is positioned above and outside the second seat S2, and a lowered position, where it protrudes below the second seat S2. Advantageously, the pushing element 26 may be sized in such a way as to bring about a cleaning of the second seat S2 during the passage from the raised position to the lowered position. The filling station SR comprises drive means, for example cam drive means, for moving the pushing element 26 between the raised position and the lowered position.

Advantageously, the pushing element 26, passing from the raised position to the lowered position, comes into contact with the side of the side walls of the second seat S2, thereby cleaning the side walls.

It should be noted that the pushing element 26 is moved from the raised position to the lowered position at the release substation ST3 (after, or during, the release of the product), in the manner described in more detail below.

It should also be noted that the pushing element 26 pushes, from the top downwards, and towards the outside, the dose 33 positioned inside the second seat S2, with the aim of favouring the transfer of the dose 33 from the second seat S2 to the rigid, cup-shaped container 2.

The release substation ST3 equipped with pushing elements 26 is extremely clean, more so than a station with screw feeders.

It should be noted that, according to an embodiment not illustrated, there is a single pushing element 26 positioned at the release region R3.

This single pushing element 26 is movable in order to make contact—at the end or during the step of releasing the dose 33 from the second seat S2 to the rigid container 2—with the side walls of the second seat S2 so as to carry out a cleaning.

With reference to the filling unit 1 in its entirety, it should be noted that the unit 1 also comprises a unit (formed by one or more electronic cards) for drive and control of the devices (7, 8) for moving, respectively, the first seat S1 and the second seat S2.

The drive and control unit is also configured to control the advance of the transport element 39 and the movable elements of the filling station SR (for example, the pistons 13, the pushing elements 26).

It should be noted that the drive and control unit coordinates and controls the step of moving all the above-mentioned elements connected to it, so as to allow the operations described below to be performed.

Figure 1:
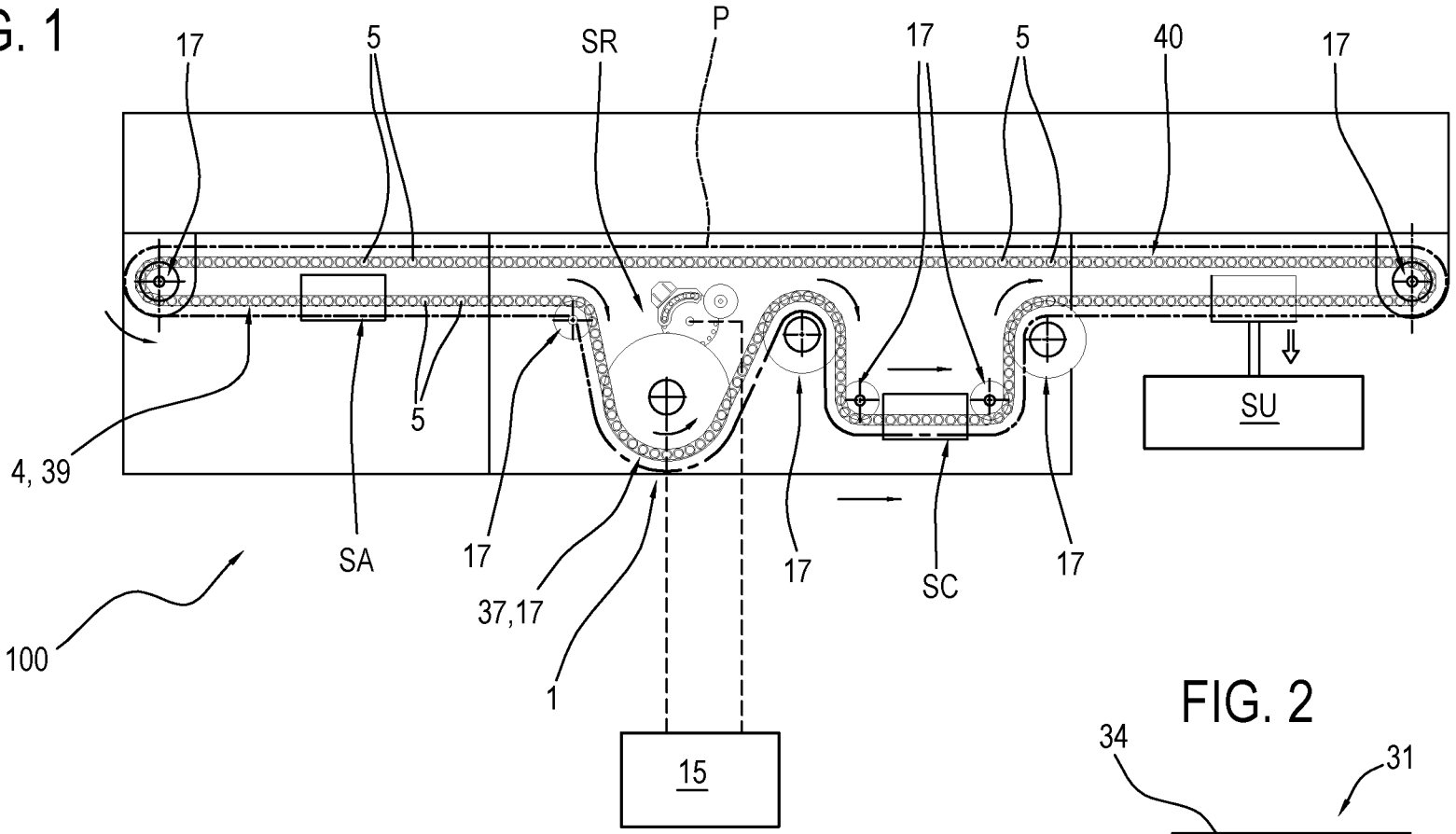
FIG. 1 is a schematic view of a machine for packaging containing elements of single-use capsules for extraction or infusion beverages comprising a filling unit according to the invention.

The filling unit 1 according to the invention may advantageously form part of a packaging machine 100 (illustrated in FIG. 1) designed for packaging single-use capsules for extraction or infusion beverages, for example of the type described above. The packaging machine 100 further comprises a plurality of stations, positioned along the first path P performed by the transport element 39, configured to operate in a synchronised fashion (preferably continuously) with the transport element 39 and with the filling station SR, including at least:

a station SA for feeding rigid containers 2 into corresponding seats 5 of the transport element 39;

a station SC for closing the rigid containers, in particular the upper opening 31 of the rigid container 2, with a lid 34;

an outfeed station which picks up the capsules 3 from the respective seats 5 of the transport element 39.

In addition to the stations listed above (SA, SR, SC, SU), the packaging machine 100 may comprise further stations, such as, for example, one or more weighing stations, one or more cleaning stations, one or more control stations and, depending on the type of capsule to be packaged, one or more stations for applying filtering elements.

The operation of the filling unit 1 is briefly described below, in particular the filling station SR, with the aim of clarifying the scope of the invention: in particular, the filling of a rigid, cup-shaped container 2 is described with reference to the embodiments illustrated in the accompanying drawings. During movement (rotation) of the first rotary element 9, a first seat S1 designed to be filled with a dose 33 of product is positioned in the region R1 for forming the dose 33, that is to say, in the proximity of the station ST1 for forming the dose 33.

It should be noted that the filling chamber 61 feeds product in the region R1 for forming the dose 33, which falls in, and fills, the first seat S1.

More specifically, the rotary element (40*a*; 40*b*) or the rotary elements (40*a*; 40*b*) allow the filling chamber (61) to be kept constantly filled, moving the product so as to keep the filling chamber (61) filled to an almost constant level.

The movement of the first rotary element 9 is, preferably, a continuous type movement. Alternatively, the movement of the first rotary element 9 is of a step type.

More specifically, the first seat S1 is completely filled at the outfeed of the region R1 for forming the dose 33.

It should be noted that at the outfeed of the region R1 for forming the dose 33, the levelling device 22 allows excess product (for example, powder or leaves) to be removed, in such a way that the first seat S1 is completely filled, or in other words, that the dose 33 comprises a surface formed by the levelling device 22.

Advantageously, the filling unit 1 can operate a step for compacting the dose 33. The compacting step is optional and can be omitted.

In the compacting step, if present, when the first seat S1 is positioned—by the rotation of the first rotary element 9—at the compacting substation ST4, the dose 33 of product inside the first seat S1 is subjected to compacting.

More in detail, the dose 33 of product inside the first seat S1 is pushed by the piston 13 upwards when the piston 13 is raised from the lower position to the compacting position, so that an upper part of the dose 33 makes contact with a lower face of the compacting disk 23, and the dose 33 is compacted inside the first seat S1. It is clear that the more the piston 13 is raised, that is to say, moved close to the compacting disk 23, the more the dose 33 is compacted.

Following a further rotation of the first rotary element 9, the first seat S1 is positioned at the transfer region R2, in which the transfer substation ST2 is present.

It should be noted that, due to the rotation of the second rotary element 10, a second seat S2 is positioned at the transfer region R2, for receiving the dose 33 from the first seat S1.

In this regard, FIGS. 7 to 10 illustrate—in a side view—a sequence of operations which are performed at the transfer region R2.

It should be noted that, preferably, the first rotary element 9 and the second rotary element 10 are moved during transfer of the dose 33 of product from the first seat S1 to the second seat S2.

In this regard, during the operating cycle the first rotary element 9 and the second rotary element 10 are, preferably, driven continuously.

It should be noted that, at the transfer region/substation (R2/ST2) the piston 13 is moved from the lowered position, wherein it defines the bottom F the first seat S1, to the raised position, so as to transfer the dose 33 from the first seat S1 to the second seat S2.

In order to perform the transfer, for a period of time depending on the speed of rotation of the respective first and second rotary elements (9, 10), the second seat S2 and the first seat S1 are superposed (at different heights) at the transfer region R2.

In the drawings from 7 to 10, the second seat S2 is positioned above the first seat S1.

It should be noted that, during transfer from the first seat S1 to the second seat S2 that is, at the transfer region R2, according to a plan view, the area occupied in plan by the first seat S1 is positioned inside the area occupied in plan by the second seat S2 (however, the first seat S1 and second seat S2 are positioned at different heights: the second seat S2 is positioned higher than the first seat S1 as shown in the accompanying FIGS. 7 to 10).

Figure 8:
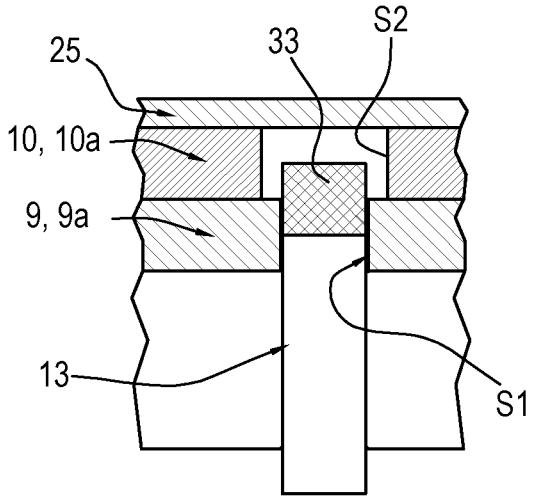

The step of transferring the dose 33 of product from the first seat S1 to the second seat S2 comprises a step for pushing the dose 33, using the piston 13, from the first seat S1 to the second seat S2 (FIG. 8).

Figure 9:
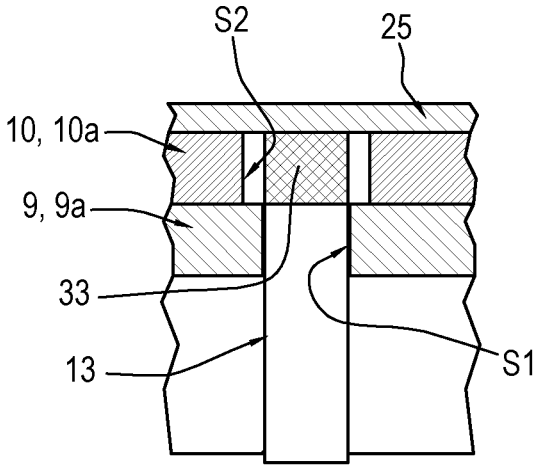
Figure 10:
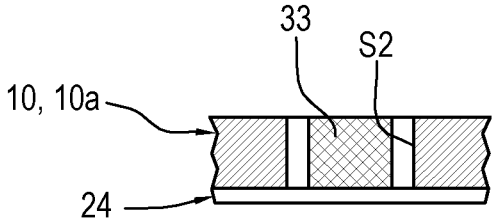

It should be noted that the upper contact element 25, present at the transfer region R2, defines an upper stop for the dose 33 of product, in such a way as to substantially prevent the escape of the dose 33 of product from the second seat S2 following the pushing action of the piston 13 (as illustrated in FIG. 9).

The upper contact element 25 is fixed to the frame 29 of the machine, that is, it is not rotated as one with the second rotary element 10.

The piston 13 in the position of escape from the first seat S1 defines, temporarily, the bottom of the second seat S2 that is, it allows the product to be supported inside the second seat S2.

The further rotation of the second rotary element 10 ensures that the second seat S2 makes contact with the bottom of the supporting element 24.

The supporting element 24 therefore replaces the piston 13 in defining the bottom of the second seat S2. At this point, the piston 13 is transferred to the region R1 for forming the dose.

The first seat S1, following the further rotation of the first rotary element 9, is positioned again at the forming station ST1 of the dose 33, where the piston 13 again adopts the lower position in which it defines the bottom of the first seat S1.

The supporting element 24 is fixed to the frame 29 of the machine, that is, it is not rotated as one with the second rotary element 10.

For this reason, the dose 33, positioned inside the second seat S2, is supported below by the supporting element 24 for a predetermined angular stroke of the second rotary element 10 and moved from the second seat S2 along the third path P2.

In other words, the dose 33 of product inside the second seat S2 slides on, and is supported by, the supporting element 24 for a predetermined angular stroke of the second rotary element 10.

It should be noted that where the supporting element 24 ends there is the release substation ST3. At the release substation ST3, the dose 33 is released from the second seat S2 to a rigid, cup-shaped container 2 positioned, at the release substation ST3, below the second seat S2.

The release substation ST3 extends along a predetermined portion of the third movement path P2 of the second seats S2.

It should be noted that the releasing step is performed preferably whilst the second element 10 is in rotation and the transport line 4 is actuated, that is to say, whilst both the second seat S2 and the rigid, cup-shaped container 2 are moved.

The release step is described below.

It should be noted that, during the release, the second seat S2 is superposed on the cup-shaped container 2, so that it is possible to transfer—by falling, or pushing, from the top downwards—the dose 33 from the second seat S2 to the cup-shaped container 2.

According to a preferred embodiment, the release of the dose 33 from the second seat S2 to the cup-shaped container 2 is achieved simply by dropping the dose 33 by gravity once the second seat S2 is superposed on the cup-shaped container 2, and the supporting element 24 has ended and no longer supports the dose 33.

Moreover, during this releasing step or immediately after, the pushing element 26 penetrates—from the top downwards—into the second seat S2, in such a way as to scrape the side walls of the second seat S2 in order to exert a cleaning action.

If the simple force of gravity is insufficient to allow the transfer of the dose 33, the pushing element 26 may exert a pushing action—from the top downwards—on the dose 33 of product inside the second seat S2, in such a way as to favour the escape of the dose 33 from the second seat S2 and allow the falling, that is, the release, inside the rigid, cup-shaped container 2.

It should be noted that, according to this aspect, the pushing element 26 penetrates—from the top—inside the second seat S2, pushing the dose 33 from the top downwards towards the rigid, cup-shaped container 2.

The action of the pushing element 26 therefore substantially has, in this case, a dual purpose: a cleaning of the second seat S2 and the detachment and therefore the falling of the dose 33 of beverage from the second seat S2 to the rigid, cup-shaped container 2.

Next, the pushing element 26 is again moved towards the raised position, in such a way as to disengage the second seat S2 which is moved, by the rotation of the second rotary element 10, towards the transfer substation ST2, so as to receive a new dose 33 of product.

Preferably, the second rotary element 10, during all the steps described above, is also driven substantially continuously.

Alternatively, both the first rotary element 9 and the second rotary element 10 may be operated in a step-like fashion. In the embodiment wherein the first rotary element 9 and the second rotary element 10 are driven in a step-like fashion, the step of transferring the dose 33 from the first seat S1 to the second seat S2 is performed with the first rotary element 9 and the second rotary element 10 stationary.

After the release in the rigid, cup-shaped container 2, the dose 33 inside the rigid cup-shaped container is moved, by the movement of the transport line 4, towards successive stations, comprising for example, the closing station SC (not described in detail).

It should be noted that the filling unit 1 according to this invention is particularly simple in terms of construction and at the same time is extremely flexible, and can easily adapt to different types of products and capsules.

According to the invention, a method is also defined for filling containing elements of single-use capsules for extraction or infusion beverages. As stated above, the term "containing elements" is deemed to mean both rigid, cup-shaped containers 2, of the type shown, and elements for filtration or retention of a dose of product connected to a rigid container.

The method according to the invention comprises the following steps:

- moving a succession of containing elements 2 along a first movement path P;
- preparing:
  - at least a tank 38 for feeding product;
  - at least one rotary element (40*a*; 40*b*) having a plurality of blades (60A, 60B, 60C, 60D, 60E, 60F);
  - a filling chamber (61) defining a volume for receiving product at a region (R1) for forming the dose,
- rotating about a respective axis (X4; X5) of rotation the at least one rotary element (40*a*; 40*b*) to keep the filling chamber (61) filled with product drawn from the feed tank (38);
- releasing product, at the region (R1) for forming the dose, from the filling chamber (61) inside the first containing seat (S1) movable along a second movement path (P1);
- moving the first containing seat S1 from the dose forming region R1 to a dose transfer region R2;
- transferring, at the dose transfer region R2, the dose 33 of product from the first containing seat S1 to a second containing seat S2;
- moving the second containing seat S2 from the dose transfer region R2 to a dose release region R3;
- transferring, at the dose release region R3, the dose 33 of product from the second containing seat S2 to a containing element 2 advancing along the first movement path P and positioned at the dose release region R3.

According to the method, the step of moving a succession of containing elements along a first movement path P preferably comprises moving the containing elements along a first path P which is a closed loop lying on a horizontal plane. Preferably, the succession of containing elements is moved with continuous motion.

Moreover, the step of moving the first containing seat S1 of the product towards the transfer region R2 comprises a rotation of the first seat S1 about a first vertical axis X1.

According to another aspect, the step of moving the second containing seat S2 of the product from the transfer region R2 to the release region R3 comprises a rotation of the second seat S2 about a second vertical axis X2.

According to yet another aspect, in the step of transferring the dose 33 of product from the first seat S1 to the second seat S2, the second seat S2 and the first seat S1 are superposed (positioned at different heights). Preferably, in the step of transferring the dose 33 of product from the first seat S1 to the second seat S2, the second seat S2 is positioned above the first seat S1.

Preferably, the step of transferring the dose of beverage from the first seat S1 to the second seat S2 comprises a step of pushing (preferably using a piston 13) the dose 33 from the first seat S1 to the second seat S2.

Preferably, the pushing step comprises pushing the dose 33 from the bottom upwards.

According to another aspect, during the step of moving the first seat S1 from forming region R1 to the transfer region R2, the method comprises a step of compacting the dose 33 inside the first seat S1.

Preferably, the compacting step comprises pushing (preferably using a piston 13) the dose 33 against a compacting element 28 preferably comprising a fixed compacting disk 23, which is rotatable in an idle fashion or rotatable in a motorised fashion about a vertical axis.

According to another aspect of the invention, the method comprises a step of rotating about a respective further axis (X5) of rotation a further second rotary element (40*a*) having a plurality of blades (60A, 60B, 60C, 60D, 60E, 60F), the step comprising the simultaneous rotation of the first rotary element (40*a*) and the second rotary element (40*b*).

According to another aspect, in the step of rotating about a respective axis (X4) of rotation the first rotary element (40*a*) and the second rotary element (40*b*) the trajectory of the blades (60A, 60B, 60C, 60D, 60E, 60F) of the first rotary element (40*a*) intercepts the trajectory of the blades (60A, 60B, 60C, 60D, 60E, 60F) of the second rotary element (40*b*).

The method described above is particularly simple and allows the creation of a dose 33 of product and the filling in a fast and reliable manner of a containing element, such as a rigid, cup-shaped container 2, of a single-use capsule 3 for extraction or infusion beverages with the dose 33 of product.

The invention claimed is:

1. A filling unit for filling containing elements of single-use capsules with a dose of product for extraction or infusion beverages, comprising:

a transport line for transporting the containing elements extending along a first movement path and provided with a plurality of supporting seats for the containing elements arranged in succession along the first movement path;

a filling station for filling the above-mentioned containing elements with a dose of product;

wherein the filling station comprises:

at least a first containing seat designed to receive a dose of product;

a forming substation for forming the dose inside the at least one first containing seat positioned at a region for forming the dose and provided with a release device for releasing a predetermined quantity of product forming the dose inside the at least one first containing seat, the release device comprising:

at least a hopper for feeding product;

at least one rotary element rotating about a respective axis of rotation and having a plurality of radial blades extending away from the axis of rotation; and a filling chamber positioned below the rotary element and defining a volume for receiving the product to release the product inside the at least one first containing seat at the region for forming the dose, the rotary element being configured for creating a feed flow of product from the hopper towards the filling chamber so as to keep the filling chamber filled;

at least a second containing seat designed to receive the dose of product from the at least one first containing seat;

a transfer substation for transferring the dose of product from the at least one first containing seat to the at least one second containing seat;

moving devices for moving the at least one first containing seat between the forming substation and the transfer substation and vice versa along a closed second movement path, wherein the moving devices move horizontally along a curvilinear path the first containing seat between the forming substation and the transfer substation;

a release substation for releasing the dose of product from the at least one second containing seat to a containing element transported by the transport line;

further moving devices for moving the at least one second containing seat along a closed third path lying on a horizontal plane between the transfer substation and the release substation, and vice versa, wherein the further moving devices move horizontally the second containing seat along a curvilinear path between the transfer substation and the release substation, and wherein the forming substation, the transfer substation, and the releasing substation are spaced apart on a same horizontal plane.

2. The filling unit according to claim 1, wherein the axis of rotation of the at least one rotary element is vertical.

3. The filling unit according to claim 1, wherein the at least one rotary element is positioned inside a shell in communication with the hopper and with the filling chamber.

4. The filling unit according to claim 1, wherein the release device comprises a first rotary element and a second rotary element having a plurality of respective blades so as to create a feed flow of product from the hopper towards the filling chamber to keep the filling chamber filled.

5. The filling unit according to claim 4, wherein the first and second rotary elements are mutually positioned so that a trajectory of the blades of one intercepts a trajectory of the blades of the other.

6. The filling unit according to claim 4, wherein the first and second rotary elements are mutually positioned so that a trajectory of the blades of one is different from a trajectory of the blades of the other.

7. The filling unit according to claim 1, wherein the first containing seat has a circular shape, in plan, having a predetermined diameter, the filling chamber having, at least at an outlet portion, a width in plan substantially equal to the predetermined diameter of the first containing seat.

8. The filling unit according to claim 1, wherein the at least one rotary element comprises an upper tapered portion, having a plurality of protrusions for moving the product inside the hopper and favouring the descent.

9. A filling unit for filling containing elements of single-use capsules with a dose of product for extraction or infusion beverages, comprising:

a transport line for transporting the containing elements extending along a first movement path and provided with a plurality of supporting seats for the containing elements arranged in succession along the first movement path;

a filling station for filling the above-mentioned containing elements with a dose of product;

wherein the filling station comprises:

at least a first containing seat designed to receive a dose of product;

a forming substation for forming the dose inside the at least one first containing seat positioned at a region for forming the dose and provided with a release device for releasing a predetermined quantity of product forming the dose inside the at least one first containing seat, the release device comprising:

at least a hopper for feeding product;

at least one rotary element rotating about a respective axis of rotation and having a plurality of blades extending away from the axis of rotation; and a filling chamber positioned below the rotary element and defining a volume for receiving the product to release the product inside the at least one first containing seat at the region for forming the dose, the rotary element being configured for creating a feed flow of product from the hopper towards the filling chamber so as to keep the filling chamber filled;

at least a second containing seat designed to receive the dose of product from the at least one first containing seat;

a transfer substation for transferring the dose of product from the at least one first containing seat to the at least one second containing seat;

moving devices for moving the at least one first containing seat between the forming substation and the transfer substation and vice versa;

a release substation for releasing the dose of product from the at least one second containing seat to a containing element transported by the transport line;

further moving devices for moving the at least one second containing seat between the transfer substation and the release substation, and vice versa;

wherein the blades are positioned so that a surface with larger extension of the blades is angularly inclined relative to a vertical plane.

10. A filling unit for filling containing elements of single-use capsules with a dose of product for extraction or infusion beverages, comprising:

a transport line for transporting the containing elements extending along a first movement path and provided with a plurality of supporting seats for the containing elements arranged in succession along the first movement path;

a filling station for filling the above-mentioned containing elements with a dose of product;

wherein the filling station comprises:

at least a first containing seat designed to receive a dose of product;

a forming substation for forming the dose inside the at least one first containing seat positioned at a region for forming the dose and provided with a release device for releasing a predetermined quantity of product forming the dose inside the at least one first containing seat, the release device comprising:

at least a hopper for feeding product;

at least one rotary element rotating about a respective axis of rotation and having a plurality of blades extending away from the axis of rotation; and a filling chamber positioned below the rotary element and defining a volume for receiving the product to release the product inside the at least one first containing seat at the region for forming the dose, the rotary element being configured for creating a feed flow of product from the hopper towards the filling chamber so as to keep the filling chamber filled;

at least a second containing seat designed to receive the dose of product from the at least one first containing seat;

a transfer substation for transferring the dose of product from the at least one first containing seat to the at least one second containing seat;

moving devices for moving the at least one first containing seat between the forming substation and the transfer substation and vice versa;

a release substation for releasing the dose of product from the at least one second containing seat to a containing element transported by the transport line;

further moving devices for moving the at least one second containing seat between the transfer substation and the release substation, and vice versa;

wherein the blades are positioned so that a surface with larger extension of the blades is parallel relative to a vertical plane.

11. A filling unit for filling containing elements of single-use capsules with a dose of product for extraction or infusion beverages, comprising:

a transport line for transporting the containing elements extending along a first movement path and provided with a plurality of supporting seats for the containing elements arranged in succession along the first movement path;

a filling station for filling the above-mentioned containing elements with a dose of product;

wherein the filling station comprises:

at least a first containing seat designed to receive a dose of product;

a forming substation for forming the dose inside the at least one first containing seat positioned at a region for forming the dose and provided with a release device for releasing a predetermined quantity of product forming the dose inside the at least one first containing seat, the release device comprising:

at least a hopper for feeding product;

at least one rotary element rotating about a respective axis of rotation and having a plurality of radial blades extending away from the axis of rotation; and a filling chamber positioned below the rotary element and defining a volume for receiving the product to release the product inside the at least one first containing seat at the region for forming the dose, the rotary element being configured for creating a feed flow of product from the hopper towards the filling chamber so as to keep the filling chamber filled;

at least a second containing seat designed to receive the dose of product from the at least one first containing seat;

a transfer substation for transferring the dose of product from the at least one first containing seat to the at least one second containing seat;

moving devices for moving the at least one first containing seat between the forming substation and the transfer substation and vice versa along a closed second movement path wherein the moving devices comprise a first rotary element, configured to rotate about a first axis of rotation which is substantially vertical, and on which is connected the at least one first containing seat to be rotated about the first axis of rotation;

a release substation for releasing the dose of product from the at least one second containing seat to a containing element transported by the transport line; and further moving devices for moving the at least one second containing seat along a closed third path lying on a horizontal plane between the transfer substation and the release substation, and vice versa, wherein the further moving devices comprise a second rotary element for moving the at least one second containing seat between the transfer substation and the release substation and vice versa, wherein the second rotary element is configured to rotate about a second axis of rotation that is substantially vertical.

* * * * *